US007770268B2

(12) United States Patent
Breuer

(10) Patent No.: US 7,770,268 B2
(45) Date of Patent: Aug. 10, 2010

(54) CLAMING DEVICE FOR SHOELACES OR SIMILAR FASTENER MEANS

(75) Inventor: Oliver Breuer, Kusterdinen (DE)

(73) Assignee: Deeluxe Sportartikel Handles GmbH, Kufstein (AT)

( * ) Notice: Subject to any disclaimer, the term of this patent is extended or adjusted under 35 U.S.C. 154(b) by 754 days.

(21) Appl. No.: 10/581,288

(22) PCT Filed: Nov. 29, 2004

(86) PCT No.: PCT/EP2004/013537

§ 371 (c)(1),
(2), (4) Date: May 17, 2007

(87) PCT Pub. No.: WO2005/053452

PCT Pub. Date: Jun. 16, 2005

(65) Prior Publication Data

US 2007/0256281 A1 Nov. 8, 2007

(30) Foreign Application Priority Data

Dec. 2, 2003 (DE) ..... 203 18 638 U

(51) Int. Cl.
*A43C 7/08* (2006.01)

(52) U.S. Cl. ..... 24/712.5; 24/712.7; 24/136 R; 36/50.1

(58) Field of Classification Search ..... 24/712, 24/712.1, 712.5, 712.7, 712.2, 115 M, 136 R, 24/136 K; 36/50.1, 50.5
See application file for complete search history.

(56) References Cited

U.S. PATENT DOCUMENTS

| | | | | |
|---|---|---|---|---|
| 2,200,895 | A * | 5/1940 | Rio | 24/712.5 |
| 4,807,333 | A * | 2/1989 | Boden | 24/712.5 |
| 5,361,461 | A * | 11/1994 | Anscher | 24/115 G |
| 5,572,770 | A * | 11/1996 | Boden | 24/136 R |
| 5,924,178 | A * | 7/1999 | Holmberg | 24/712.5 |
| 6,339,867 | B1 * | 1/2002 | Azam | 24/712.5 |
| 6,505,424 | B2 * | 1/2003 | Oorei et al. | 36/129 |
| 6,775,928 | B2 * | 8/2004 | Grande et al. | 36/50.1 |
| 6,889,407 | B2 * | 5/2005 | Martin | 24/136 R |
| 7,360,282 | B2 * | 4/2008 | Borsoi | 24/136 R |
| 2006/0179685 | A1 * | 8/2006 | Borel et al. | 36/50.1 |

FOREIGN PATENT DOCUMENTS

| | | |
|---|---|---|
| DE | 232 027 | 12/1909 |
| DE | 891 065 | 7/1949 |
| DE | 28 33 875 | 3/1980 |
| DE | 197 10 702 1 | 9/1998 |
| FR | 2 706 743 | 12/1994 |
| FR | 2 792 506 | 10/2000 |
| FR | 2821 249 | 8/2002 |

* cited by examiner

*Primary Examiner*—Victor Batson
*Assistant Examiner*—Michael Lee
(74) *Attorney, Agent, or Firm*—Boyle Fredrickson, S.C.

(57) ABSTRACT

Clamping device (1) for shoelaces (2) or the like lacing devices with clamping jaws, between which the shoelace (2) can be locked in a closed position and moved back and forth in an open position, wherein the clamping device (1) is engageable in an open position wherein the engagement in an open position of the clamping device (1) is releasably by a movement of the shoelace (2) to be locked in a direction out of the pulling direction of the shoelace (2) as well as a shoe with a clamping device (1) in accordance to the invention.

17 Claims, 3 Drawing Sheets

CLAMING DEVICE FOR SHOELACES OR SIMILAR FASTENER MEANS

FIELD OF THE INVENTION

The invention relates generally to clamping devices, and in particular to a clamping gadget for shoelaces or the like.

BACKGROUND AND SUMMARY OF THE INVENTION

Lacing shoes are still commonly spread in comparison to shoes without laces such as the so-called slip-on shoes or in comparison to shoes with a velcro fastener. Usually shoelaces are tied up to bowknots after putting on the shoes to protect it from self opening.

To avoid the necessity of binding bowknots, a clamping gadget for shoelaces is described in DE 891 065, allowing to pull the shoelaces to any tightness and clamping it. An improper loop, that opens when putting off the shoes and a resulting knot is avoided by means of the previously mentioned clamping gadget. This clamping mechanism described in DE 891 065 basically consists of a wedge shaped casing and a corresponding wedge. In closed position the wedge presses the shoelace ends against the casing side and locks the shoelaces by clamping.

To attain an open position of the clamping gadget, i.e. a position, where the shoelaces can be moved back and forth in the clamping mechanism, the wedge has to be set to the open position manually. To avoid clamping the shoelace in a closed position again, the wedge must be continuously held by hand in an open position, but this means, that one user's hand is needed to keep the wedge in open position, as long as the shoelace has to be moved. For this reason, the user has only one hand free for other tasks, e.g. tightening the laces.

The problem, that in the open position of the clamping gadget always one hand has to be free for holding the open position of the wedge or a corresponding lever, is solved by the design in accordance with U.S. Pat. No. 6,339,867 B1. From this previously mentioned document a clamping gadget consists of a hollow body according to U.S. Pat. No. 6,339,867 B1 containing two clamping cams as well as a cogged wheel to lock the shoelaces. The hollow body is connected with a spring pressing the cogged wheel in the hollow body in a closed position and supporting the clamping of the shoelaces between wheel and cams. The hollow body can be engaged in open position and the release of the engagement is effected by pulling the shoelace in its pulling direction against the force of a second spring. A certain force has to be exceeded to attain that, determined by the previously mentioned spring.

The force needed to set the clamping gadget in accordance with U.S. Pat. No. 6,339,867 from its open position to a closed position is increased by the spring force. Furthermore, the clamping mechanism shows a complex design in accordance with the previously mentioned document. Additionally, the tightening degree of the shoelaces is fixed by the above described spring, so it is not possible to tie the shoe relatively loose or relatively tight in adaptation to the need or application field. The user is forced to a certain tightening by the previously mentioned design, that is not individually adjustable and decreases unwanted in the course of time by the weakening spring force.

The present invention is intended to show a clamping mechanism for shoelaces as well as the corresponding shoe, designed as simple as possible and allowing an engagement in open position with a minimum of constructive complexity.

So it is an essential feature of the invention, that the locking in open position of the clamping gadget can be released by a movement of the locked shoelace in one direction of the pulling direction of the shoelace. This ensures a simple design as well as an engagement release with low effort. The release of the locking against the force of an elastic element is not necessary.

By preference, a gadget in accordance with the invention consists of a base part holding the shoelace, a sliding part attached to the base part and an elastic element effective between base part and slider, against its force the clamping mechanism can be set into the open position. A gadget designed this way consists of just three components emphasizing the low constructive complexity also resulting in low production costs.

In a preferred design version base and slider are shaped shell-like and face each other in a way, that they form a holding space for the shoelaces. A shell-shaped design of base and slider ensures a simple production on the one hand, and material savings on the other hand, as such a gadget doesn't need a separate casing. The casing of conventional designs is delimited by base and slider in accordance with the invention.

By preference the shoelace is clampable between base and slider. This design version also emphasizes the low constructive complexity, especially in comparison with the state of technology. Complicated mechanisms such as cogged wheels or the like are not necessary to clamp the shoelace.

Preferably the sides of base and/or slider facing the shoelace are cogged to ensure a secure clamping of the shoelace.

The elastic element is preferably a spring mounted between base and slider, especially a helical compression spring, as it is low cost and ensures a reliable effect.

In a preferred design version the base includes a baseplate for the attachment to the tongue of a shoe or to the rim of a rucksack opening or the like container. By attachment of the clamping gadget locking the open position is solved even more simply and user-friendly.

By preference, the slider is shaped like a trough or lever to set the clamping mechanism from the closed position to its open position. A trough form has the advantage, that it can be adapted to the form of a finger and the mechanism can be handled for example with a thumb. Additionally, no protruding parts are present in the gadget. A lever shaped otherwise, for example in the form of a projecting lever, allows an easy grasping of the lever, for example for users with low finger power.

The slider preferably includes a protrusion to engage the slider at the base in open position, where the slider is fixed in its engaged position against the effect of the elastic element mounted between slider and base. By preference, the projecting notch can be moved past an edge of the base in a way, that the slider can be swiveled into the motion path of the shoelaces. These constructive measures ensure a secure engagement of the slider with a minimum constructive complexity.

Alternatively, the notched protrusion may also be located at the base and the corresponding notch at the slider.

The purpose of the present invention relating to the shoe is solved by providing a shoe with a clamping gadget solved according to one of the previously described design versions. The advantages of such a shoe are analogous to the previously described design versions of the clamping gadget.

By preference, the shoelace forms a loop at one end of the lever to allow a handling with one hand or a single finger. So the operation of the shoe can be performed with one hand. Setting the clamping mechanism from the closed position to the open position as well as a following tightening or loosening and setting the clamping mechanism to the closed position again can be performed with one hand or, if the baseplate of the clamping gadget is attached to a shoe tongue or the like, it can be handled with a single finger.

For a better grasping of the shoelace or to ensure, that the shoelace doesn't cut into the finger at a high pulling force, the shoelace loop can be equipped with a lever, for example in a husk shape.

By preference, the shoelace ends or the shoelace loop and/or eventually the lever of the shoelace are connected by an elastic band, so that the shoelace and eventually its lever is pulled towards the shoe. This ensures, that the shoelace ends or the shoelace loop and/or the lever of the shoelace lies flat on the shoe to avoid the danger of stumbling. Additionally, the lever is always in a reachable position.

The elastic band is preferably mounted on the shoe in a band guide or in band liners, also including the guides for the shoelaces. This multi-functionality means a low material expense and provides an attractive shoe design.

In a preferable design version the elastic band is lined by a guideway mounted to the shoe, especially around the shaft of the shoe, i.e. the elastic band is held in position by the guideway to prevent it from slipping. This ensures the desired attachment of the lace at the shoe.

In explanation of the principle of the proposed clamping gadget and the proposed shoe and to illustrate the related design example the following figures are intended; these are showing.

BRIEF DESCRIPTION OF THE DRAWINGS

The drawings furnished herewith illustrate a preferred construction of the present invention in which the above advantages and features are clearly disclosed as well as others which will be readily understood from the following description of the illustrated embodiment.

In the drawings.

DETAILED DESCRIPTION OF THE DRAWINGS

Figure 1:
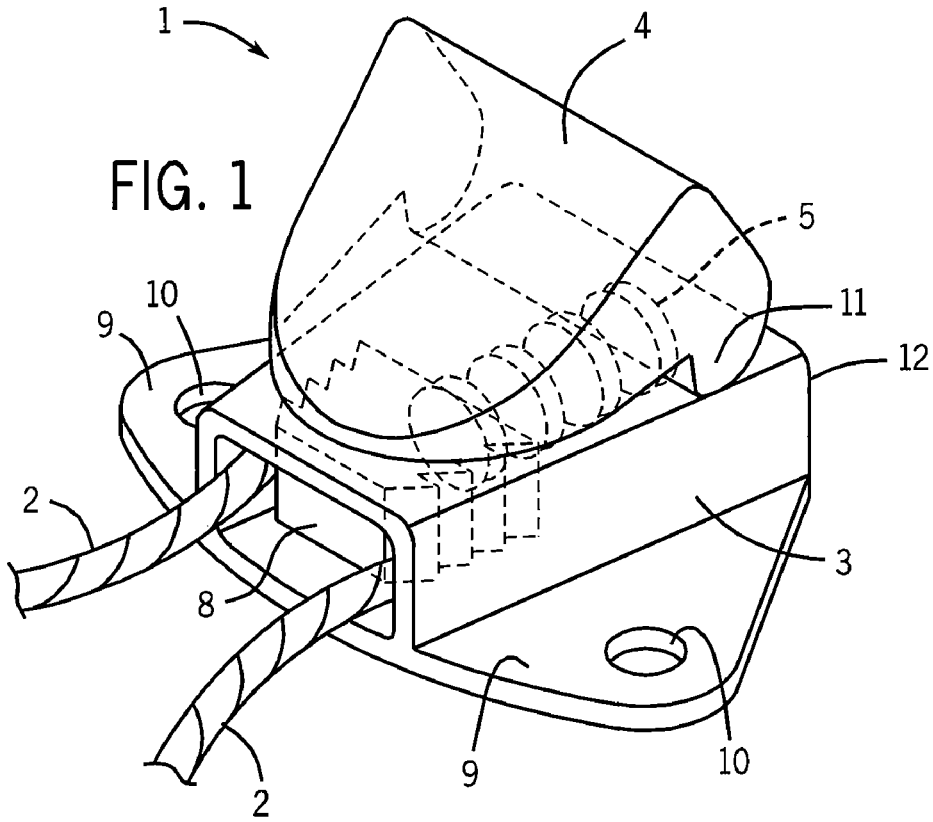
FIG. 1: A schematic overall view of a clamping gadget including shoelaces in a closed position.
Figure 2:
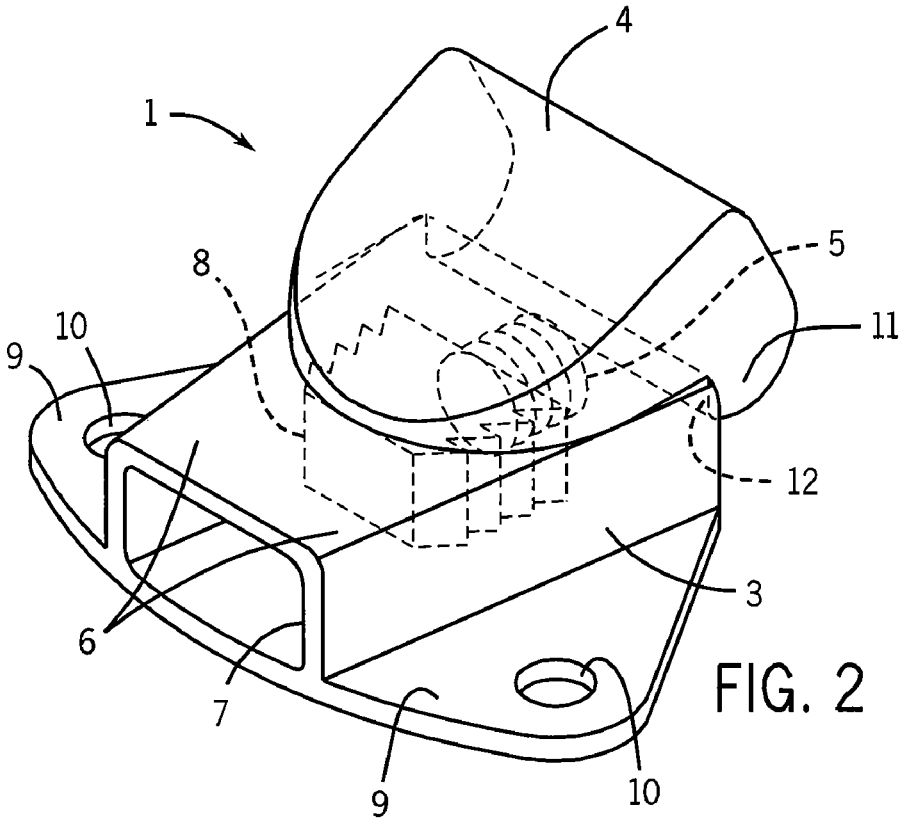
FIG. 2: The clamping gadget of FIG. 1, once again in a schematic view in its open position.
Figure 3:
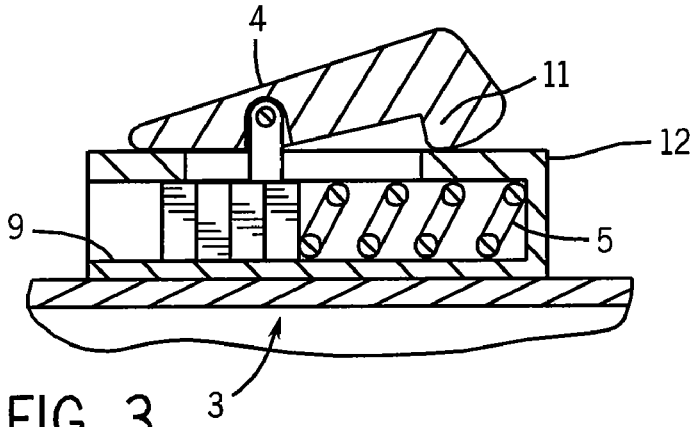
FIG. 3: The clamping gadget of the previous figures in closed position in a section view.
Figure 4:
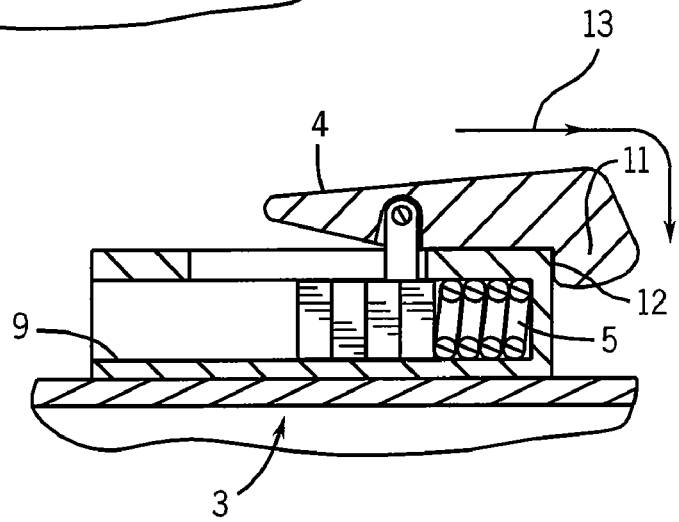
FIG. 4: The clamping gadget in its open position in a section view.
Figure 5:
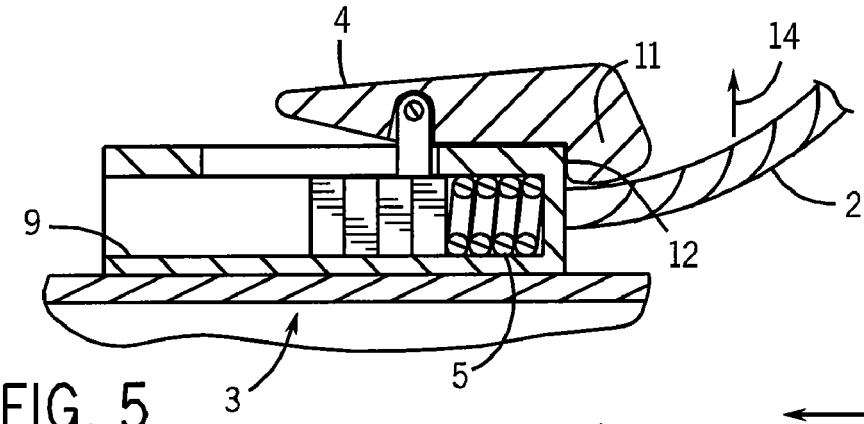
FIG. 5: The clamping gadget in its open position analogous to FIG. 4, however with shoelaces and a schematic drawing of the release process from the engagement, once again in a section view.
Figure 6:
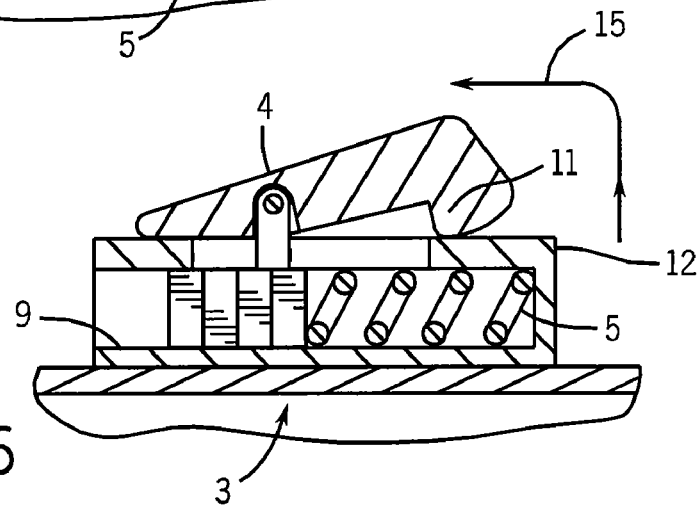
FIG. 6: End of the cycle closed position-open position-closed position, i.e. the clamping gadget back in its closed position in a section view.

The FIGS. 1 and 2 are showing a clamping gadget for shoelace 2 in a schematic perspective view, where FIG. 1 also indicates the clamped shoelace besides the clamping gadget 1. The clamping mechanism consists of a base 3 and an elastic element in the from of a helical compression spring 5, effective between base 3 and slider 4, against its effect the clamping mechanism can be set to the open position. It is a remarkable feature of the open position, that in this position shoelace 2 can be moved freely in the clamping gadget. Therefore, closed position means, that shoelace 2 is locked in the clamping mechanism. A complete cycle of the clamping gadget, beginning with the closed position of clamping gadget 1, followed by reaching the open position and finally reaching the closed position of the clamping gadget again is discussed in the following description of the FIGS. 3 to 6.

Base 3 and slider 4 are both shaped shell-like, i.e. each one is open at least at one end. They are facing each other in a way to form a shoelace holding space 6. In the shoelace holding space shoelace 2 is lined in the clamping gadget 1 and can be clamped between base 3 and slider 4. To ensure a secure locking of shoelace 2 the side 7 of the base 3 facing the shoelace (see FIG. 2) as well as the side 8 of slider 4 facing the shoelace are designed cogged (the cogging at the side 7 of base 3 facing the shoelace is not shown in the figures for the reason of clarity). The base 3 is designed with a baseplate 9 for attaching the clamping gadget 1 for example at the tongue of a shoe. The attachment is effected by the borings 10 at the baseplate 9, located on both sides of the clamping gadget 1. The attachment at the shoe tongue can performed in many ways, for example by sewing or by riveting or a similar mounting procedure. At this point, it shall be noted furthermore, that a clip-like shaping of the baseplate 9 is also possible in a way, to fix the clamping gadget virtually like a paper clip to the shoe tongue. At the upper side of the slider a finger trough is formed (not shown in the figures), used as a lever for slider 4. So this can be operated with one finger, preferably with the user's thumb.

Additionally, slider 4 is designed with a protrusion 11 to engage slider 4 in open position of the clamping gadget 1 at the side of base 3 (see FIG. 2). Slider 4 is held in engagement position against the effect of compression spring 5, mounted between slider 4 and base 3 as previously mentioned. For this purpose the notch protrusion 11 can be moved past an edge 12 at the base 3 in a way, that slider 4 can be swiveled into the motion path of shoelace 2. By this swiveling procedure the protrusion 11 of slider 4 and the edge 12 of base 3 are engaged with each other.

FIGS. 3 to 6 show a complete movement cycle of slider 4 in the clamping gadget 1. Beginning with the state showed in FIG. 3 corresponding to the closed position, slider 4 is moved by the thumb in direction of edge 12 of base 3 against the effect of the helical compression spring 5.

As soon as protrusion 11 of slider 4 has reached or passed the edge 12 of base 3, slider 4 can be swiveled in direction of baseplate 9; as indicated by arrow 13. By this procedure the protrusion 11 of slider 4 and the edge 12 of base 3 are reaching a mutual engagement position. The clamping gadget 1 is engaged in open position.

To release the engagement, the user pulls out shoelace 2 in a direction of the shoelace's pulling direction (indicated by arrow 14), after the shoelace 2 is tightened as desired. Thereby slider 4 is lifted and set back to its closed position by the effect of the helical compression spring 5 (indicated by arrow 15 in FIG. 6).

Figure 7:
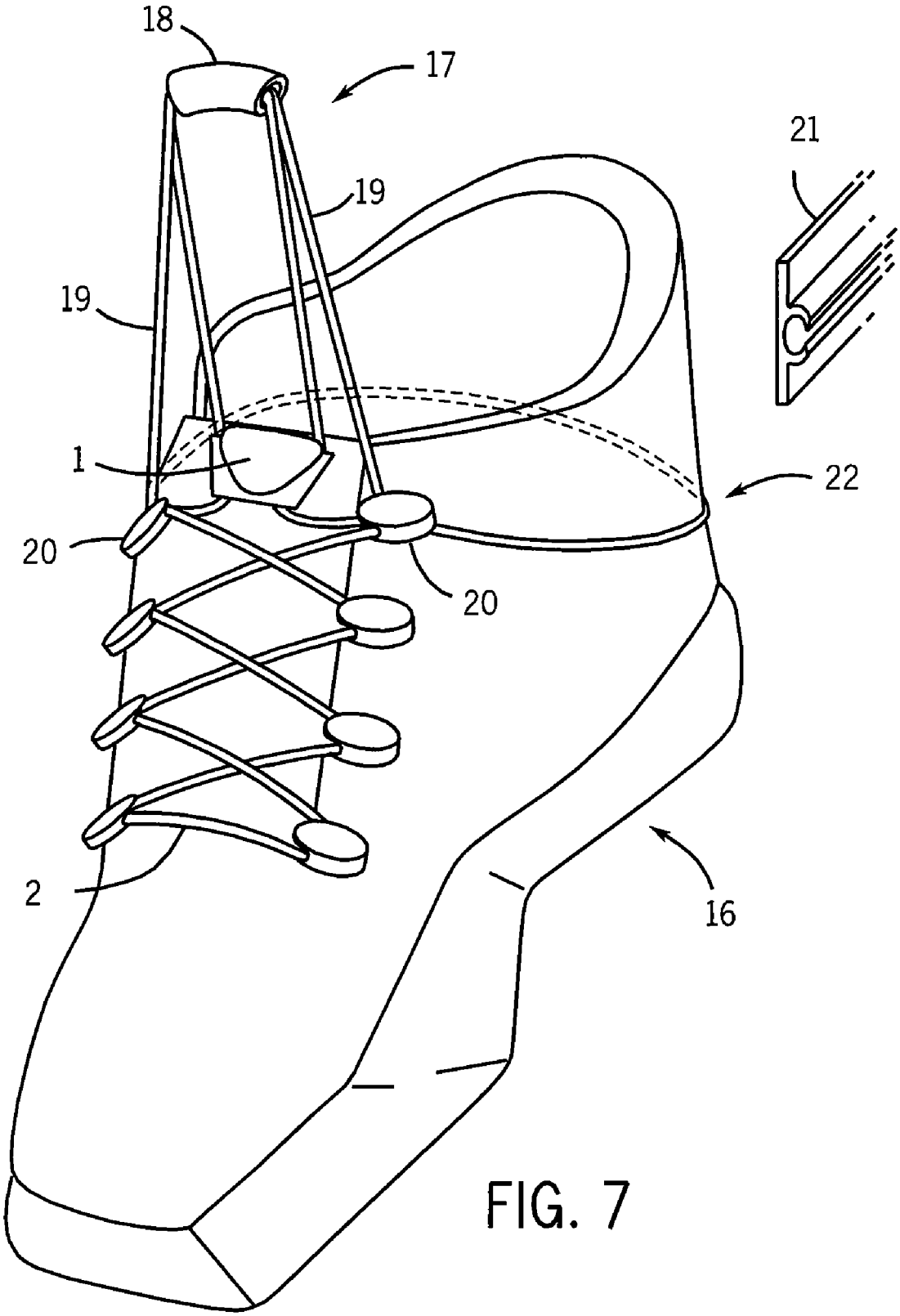
FIG. 7: A shoe showing a clamping gadget for shoelaces in a perspective view.

FIG. 7 shows a shoe, that can be locked by shoelace 2. The shoe 16 is equipped with a clamping gadget 1, a previously described in detail. At one handling end 17 shoelace 2 forms a loop, so that the handling of shoelace 2 is possible with one hand or even with a single finger. The loop at the handling end 17 is fitted with a husk-shaped lever 18 made of plastic or leather to ensure, that the shoelace doesn't cut in the finger or in the hand, even when the shoelace is pulled strongly. In addition to that, an elastic band 19, lined through a guide 20 on the shoe, reaches through the husk-shaped lever 18. The guides 20 are here part of of a guide for the shoelace 2 at the same time. This multi-functionality of the guides 20 provides a low production effort as well as an attractive design.

As long as the user does not interfere, the shoelace loop at the handling end 17 of shoelace 2 as well as lever 18 is pulled towards the shoe 16 by the elastic band 19. The elastic band is lined around the shaft 22 of the shoe by a guideway 21 attached to the shoe.

All characteristics revealed in the application documents are claimed as inventory important, as far as they are new, single or in combination according to the state of technology.

REFERENCE MARKS

1 Clamping gadget
2 Shoelace
3 Base
4 Slider
5 Helical compression spring
6 Shoelace holding space
7 Side of base 3 facing the shoelace
8 Side of slider 4 facing the shoelace
9 Baseplate
10 Boring
11 Protrusion at the slider
12 Edge at the base
13, 14, 15 Arrow
16 Shoe
17 Handling end of shoelace 2
18 Lever
19 Elastic band
20 Band guide
21 Guideway
22 Shaft of shoe 16

The invention claimed is:

1. A clamping device for a shoelace, comprising:

a base having an inner surface defining a cavity for receiving the shoelace and an upper transverse edge;

a movable slider partially received in the cavity of the base, the slider movable between a first clamping position wherein the shoelace is captured between the slider and the inner surface of the base and a second, non-clamping position wherein the shoelace may be drawn through the cavity;

a biasing structure for urging the slider towards the clamping position; and a protrusion extending from the slider, the protrusion movable between a first position wherein the slider is free to move to the clamping position and a second position wherein the protrusion extends over the upper transverse edge of the base for selectively maintaining the slider in the non-clamping position such that movement of the shoelace in a shoelace pulling direction causes the protrusion to move from the second position to the first position.

2. The clamping device of claim 1 wherein the biasing structure includes a helical compression spring mounted between the base and the slider.

3. The clamping device of claim 1 wherein the inner surface of the base includes a cogged portion for engagement with the shoelace with the slider in the clamping position.

4. The clamping device of claim 1 wherein the slider includes an outer surface having a cogged portion, the cogged portion of the outer surface of the slider engaging the shoelace with the slider in the clamping position.

5. The clamping device of claim 1 wherein the base includes a baseplate for attaching the clamping device to a shoe.

6. The clamping device of claim 1 wherein the slider includes a lever for facilitating the movement of slider from the clamping position to the non-clamping position.

7. A clamping device for a shoelace, comprising:

a base defining a cavity and having a first cogged surface, a second cogged surface, and an upper transverse edge;

a movable slider partially received in the cavity of the base and having first and second cogged surfaces, the slider movable between a first clamping position and a second, non-clamping position;

a biasing structure for urging the slider towards the clamping position; and a protrusion extending from the slider, the protrusion movable between a first position wherein the slider is free to move to the clamping position and a second position wherein the protrusion extends over the upper transverse edge of the base for selectively maintaining the slider in the non-clamping position such that movement of the shoelace in a shoelace pulling direction causes the protrusion to move from the second position to the first position;

wherein:

the first cogged surface of the slider and the first cogged surface of the base define a first passageway for receiving a first portion of the shoelace therethrough;

the second cogged surface of the slider and the second cogged surface of the base define a second passageway for receiving a second portion of the shoelace therethough;

the first portion of the shoelace is clamped within the first passageway with the slider in the clamping position; and the second portion of the shoelace is clamped within the second passageway with the slider in the clamping position.

8. The clamping device of claim 7 wherein the base includes a baseplate for attaching the clamping device to a shoe.

9. The clamping device of claim 7 wherein the slider includes a lever for facilitating the movement of slider from the clamping position to the non-clamping position.

10. A shoe, comprising:

a shoelace for maintaining the shoe on a foot of a wearer, the shoelace having first and second ends; and a clamping device for securing the shoelace at a used desired location, the clamping device including:

a base having an inner surface defining a cavity for receiving the shoelace and an upper transverse edge;

a movable slider partially received in the cavity of the base, the slider movable between a first clamping position wherein the shoelace is captured between the slider and the inner surface of the base and a second, non-clamping position wherein the shoelace may be drawn through the cavity;

a biasing structure for urging the slider towards the clamping position; and a protrusion extending from the slider, the protrusion movable between a first position wherein the slider is free to move to the clamping position and a second position wherein the protrusion extends over the upper transverse edge of the base for selectively maintaining the slider in the non-clamping position such that movement of the shoelace in a shoelace pulling direction causes the protrusion to move from the second position to the first position.

11. The shoe of claim 10 wherein first and second ends of the shoelace are interconnected to define a loop so as to permit handling of the shoelace with a single finger.

12. The shoe of claim 11 further comprising a handle overlapping the first and second ends of the shoelace.

13. The shoe of claim 12 further comprising a body and an elastic band operatively connected to the body and the handle, the elastic band urging the shoelace and the handle toward the body.

14. The shoe of claim 13 further comprising a band guide for receiving the elastic band and guiding the movement thereof.

15. The shoe of claim 14 wherein the body includes a receiving channel affixed thereto and wherein the elastic band is guided through the receiving channel.

16. The shoe of claim 10 further comprising a tongue and wherein the base include a baseplate operatively connected to the tongue.

17. The shoe of claim 10 wherein the base includes a clip for operatively connecting the clamping device to the tongue.

* * * * *